US005335844A

United States Patent [19]

Young

[11] Patent Number: 5,335,844

[45] Date of Patent: Aug. 9, 1994

[54] FRUIT AND PRODUCE CONTAINER

[76] Inventor: Thomas R. Young, 1535 E. Orangewood, No. 118, Anaheim, Calif. 92803

[21] Appl. No.: 45,756

[22] Filed: Apr. 8, 1993

Related U.S. Application Data

[63] Continuation-in-part of Ser. No. 932,892, Aug. 19, 1992.

[51] Int. Cl.[5] ..... B65D 5/32

[52] U.S. Cl. ..... 229/23 R; 229/149; 229/199; 229/919

[58] Field of Search ..... 229/23 R, 149, 199, 229/915, 919, DIG. 11; 206/509

[56] References Cited

U.S. PATENT DOCUMENTS

| | | | |
|---|---|---|---|
| 272,327 | 2/1883 | Rogers . | |
| 1,951,972 | 3/1934 | Fraser | 220/97 |
| 2,191,291 | 2/1940 | Smith | 229/52 |
| 2,235,709 | 3/1941 | Hearn et al. | 206/73 |
| 2,268,236 | 12/1941 | Baird | 229/30 |
| 2,276,374 | 3/1942 | Derman | 229/32 |
| 2,662,620 | 12/1953 | Vojta | 190/54 |
| 2,687,157 | 8/1954 | Cowan | 150/0.5 |
| 2,791,366 | 5/1957 | Geisler | 229/35 |
| 2,868,430 | 1/1959 | Hamilton | 229/34 |
| 2,896,835 | 7/1959 | Burkhardt et al. | 229/34 |
| 2,914,235 | 11/1960 | Jones | 229/34 |
| 2,987,198 | 6/1961 | Crane | 214/10.5 |
| 3,031,125 | 4/1962 | Felton | 229/34 |
| 3,118,563 | 1/1964 | Suchodolski | 220/97 |
| 3,211,326 | 10/1965 | Davis | 220/97 |
| 3,226,008 | 12/1965 | Chiorri | 229/49 |
| 3,373,921 | 3/1968 | Crane | 229/23 |
| 3,434,648 | 3/1969 | DuBarry, Jr. | 229/23 R |
| 3,463,378 | 8/1969 | Van Daalen | 229/14 |
| 3,487,991 | 1/1970 | Stearn | 229/23 |
| 3,544,021 | 12/1970 | Wilson et al. | 220/7 |
| 3,606,949 | 9/1971 | Joyce | 211/126 |
| 3,659,774 | 5/1974 | Mielke | 229/52 B |
| 3,820,706 | 6/1974 | Gibson et al. | 229/34 R |
| 3,850,362 | 11/1974 | Stollberg et al. | 229/23 R |
| 3,899,121 | 8/1975 | Herbetke | 229/34 R |
| 3,915,372 | 10/1975 | Crane | 229/23 R |
| 3,935,990 | 2/1976 | Crane | 229/34 R |
| 3,953,991 | 2/1976 | Crane | 229/34 R |
| 4,039,119 | 8/1977 | Crane | 229/34 HW |
| 4,039,121 | 8/1977 | Crane | 229/52 A |
| 4,068,794 | 1/1978 | Lawrence | 229/23 R |
| 4,126,265 | 1/1978 | Holmes | 229/32 |
| 4,266,714 | 5/1981 | Crane | 229/34 HW |
| 4,341,338 | 7/1982 | Arnold | 229/919 |
| 4,373,659 | 2/1983 | Cornell et al. | 229/32 |
| 4,389,013 | 6/1983 | Hall et al. | 229/915 |
| 4,482,074 | 11/1984 | Lalley | 220/4 F |
| 4,685,610 | 8/1987 | Carter et al. | 229/23 R |
| 4,807,756 | 2/1989 | Young | 206/509 |
| 4,911,356 | 3/1990 | Townsend et al. | 229/919 |
| 4,932,586 | 6/1990 | Young | 229/198 |
| 4,938,118 | 7/1990 | Wolfges et al. | 91/361 |
| 5,038,998 | 8/1991 | Morris et al. | 229/915 |
| 5,143,278 | 9/1992 | Petrikis et al. | 229/23 R |

FOREIGN PATENT DOCUMENTS

| | | | |
|---|---|---|---|
| 738997 | 3/1970 | Belgium | 229/918 |
| 808228 | 2/1937 | France | 229/23 R |
| 071048 | 10/1959 | France | 229/49 |
| 76393 | 8/1961 | France | 229/DIG. 11 |
| 1534447 | 6/1968 | France | 229/23 R |
| 2240156 | 3/1975 | France | 229/DIG. 11 |
| 2610292 | 8/1988 | France | 229/23 R |
| 515271 | 4/1957 | Italy | 229/198 |
| 667808 | 9/1964 | Italy | 229/199 |
| 1097878 | 1/1968 | United Kingdom | 229/23 R |

*Primary Examiner*—Gary E. Elkins

*Attorney, Agent, or Firm*—Stetina and Brunda

[57] ABSTRACT

A corrugated cardboard container for storing and transporting produce and the like has a bottom member, and a plurality of upwardly extending planar first members formed to the bottom member and defining walls of the container. The bottom member and first members are comprised of corrugated cardboard. At least one, preferably two, upwardly extending second members are attached to the bottom member and define reinforcement for increasing the structural strength of the container. The second members preferably define end members of the container and comprise solid fiberboard which has substantially greater structural strength than corrugated cardboard. Such paperboard reinforcements are resistent to the effects of moisture. Thus, a produce container is provided which has improved structural strength and which does not degrade due to the presence of moisture.

16 Claims, 3 Drawing Sheets

FRUIT AND PRODUCE CONTAINER

RELATED APPLICATIONS

The present patent application is a continuation-in-part application of U.S. patent application Ser. No. 07/932,892, filed on Aug. 19, 1992 and entitled FRUIT AND PRODUCE CONTAINER, pending the contents of which are hereby incorporated by reference.

FIELD F THE INVENTION

The present invention relates generally to containers and more particularly to a reinforced fruit and produce container used to store and transport fruit, produce, and the like.

BACKGROUND OF THE INVENTION

Containers for transporting fruit and produce, such as grapes and the like, from the fields where they are grown to markets where the fruit or produce is purchased by consumers are well known. Such containers are generally formed of either wood or corrugated cardboard. Wood containers resist degradation due to handling and/or moisture absorption substantially better than those formed of corrugated cardboard and are thus structurally superior thereto.

However, the cost of shipping produce is proportional to the weight thereof, including the container. The use of the heavier wood containers therefore results in substantially greater shipping expense. As such, because wood containers are substantially heavier than corrugated cardboard containers, the cost to ship produce contained therein is substantially greater.

Additionally, wooden containers are comparatively more expensive to manufacture than corrugated cardboard containers. Furthermore, wood containers cannot be recycled, whereas corrugated cardboard produce containers can be recycled into various paper products.

Because the cost of storage and shipping of fruit and produce is, at least in part, further determined by the amount of floor space occupied thereby, it is commonly necessary that containers be configured in relatively high stacks so as to minimize the floor space occupied thereby. Thus, it is necessary that such containers possess sufficient structural strength to support the weight of those containers above.

When corrugated cardboard containers are stacked, it is common for lower stacked corrugated containers to splay or spread apart such that the four corners of those containers stacked above tend to slide into the lower containers and thereby damage the produce contained therein. Also, degradation of such lower containers frequently results in collapse of the entire stack, thereby further increasing the amount of damage to the fruit or produce contained therein. Thus, it is desirable that the structural integrity of such containers be maintained so as to prevent damage to the contents of such containers.

Transportation of the fruit and produce containers commonly exposes them to moisture which tends to deteriorate or degrade the containers, particularly those comprised of corrugated cardboard. Handling of the containers during the loading and unloading processes subjects them to impacts which may cause damage thereto. Wetted corrugated cardboard containers are particularly susceptible to such damage.

Also, when a vehicle transporting the containers turns, the inertia of the containers tends to cause the stacks to twist or sway, thereby increasing the forces applied thereto, particularly to those containers at or near the bottom member of the stack. Such forces may thus cause damage to the stacked containers. Wetted corrugated cardboard containers are particularly susceptible to such damage.

The fruit or produce contained within such stored and/or transported containers is frequently wet. Fruit and produce may be picked wet or may sweat and thereby release moisture during shipping and storage. Also, ambient moisture may condense upon the product and/or container. Such ambient moisture is typically absorbed by corrugated cardboard containers, thus causing structural degradation thereof.

Prior art corrugated produce containers are frequently configured such that, when stacked, channels are formed therebetween and thereinto in order to facilitate adequate ventilation of the produce contained therein and to insure effective control of the environment, i.e., temperature and humidity. Uppermost and lowermost longitudinal corners of the containers may be beveled in order to form air conduits in the region where four stacked containers abut. Apertures formed along the bevel of each container facilitate air flow from the conduit into the container. By utilizing the conduits formed by such bevels and apertures, the application of pesticides and the like or inert gasses reduces the likelihood of insect infestation and/or the growth of fungus. Two examples of contemporary containers having such bevels and apertures are those produced by Maxco, of Reedley, Calif. and those produced by Weyerhauser of Bakersfield, Calif.

However, in forming such bevels, the structural strength, i.e., the ability to withstand stacking, of the containers is substantially reduced and the problems associated with wetting of the containers is exacerbated. Thus, the use of such bevels to form conduits further decreases the useful life of corrugated cardboard containers.

Stacking alignment tabs are typically formed along the upper edge of each end member of the produce containers. The stacking alignment tabs are configured to be received within cut-outs formed along the lower edge of each of the containers in order to facilitate stacking thereof. When containers are stacked one atop another, the stacking alignment tabs of the lower container are positioned within the cut-outs of the upper container, thereby assuring proper alignment of the containers in order to form a straight vertical stack. This interlocking of adjacent containers also makes each stack more stable and thus less likely to topple over.

The storage life of produce stored within such containers is typically not limited by degradation of the fruit contained therein, but rather is often limited by the storage life of the corrugated cardboard containers themselves. Degradation of the corrugated cardboard containers due to handling and the absorption of moisture commonly prevents such containers from being used for extended periods of time.

In light of the problems associated with transporting and storing produce in corrugated cardboard containers, it is desirable that the containers be reinforced in some manner so as to improve the structural strength thereof. It is important, however, that the means utilized to reinforce the corrugated cardboard containers not add significantly to the weight, bulk, or to the cost of manufacturing the containers. Thus, the design of such reinforced corrugated cardboard containers must lend itself to simple and inexpensive mass production techniques.

Reinforcement should be as simple in design as possible and should be comprised of inexpensive materials. The reinforced portion of the container should be recyclable such that the entire container may be recycled without the need to separate the reinforced portion therefrom. By simplifying the design of the reinforced portion of the cardboard container, automation of the fabrication process is maximized and the cost associated therewith minimized.

Furthermore, it is desirable that the reinforced portion of the container be impervious to degradation due to the presence of moisture. Thus, it is desirable that the strength of the material utilized in the fabrication of the reinforced portion of the container not be affected by the absorption of moisture. As such, although the prior art has recognized to a limited extent the problem of increasing the strength of corrugated cardboard containers, the proposed solutions, to date, have been ineffective in providing a satisfactory remedy.

SUMMARY OF THE INVENTION

The present invention addresses and alleviates the above-mentioned deficiencies associated with the prior art. More particularly, the present invention comprises a corrugated cardboard box or container for storing and transporting fruit, produce, and the like. The corrugated cardboard container has a bottom member, and a plurality, preferably two, upwardly extending planar first members formed to the bottom member and defining walls of the container or box. The upwardly extending first members preferably define side members of the containers. The bottom member and first members are comprised of corrugated cardboard.

At least one, preferably two, upwardly extending second members define reinforcement for increasing the structural strength of the container. The upwardly extending second members preferably define end members of the container. The second members are comprised of solid fiberboard, which has greater structural strength than corrugated cardboard. Such solid fiberboard is resistent to the effects of moisture. Thus, a fruit or produce container is provided which improves structural strength of the container and which does not degrade due to the presence of moisture.

Thus, in the preferred embodiment of the present invention, the two first members are rectangular in shape and define the sides of a box whereas the two second members are also rectangular in shape and define the ends of a box.

The reinforced corrugated cardboard container thus preferably comprises a rectangular bottom member, two rectangular side members formed to said bottom men%her and extending upwardly therefrom, and two rectangular end members formed to the bottom member and extending upwardly therefrom. The bottom member and two side members are formed of corrugated cardboard and the two end members are formed of solid fiberboard. The solid fiberboard end members define reinforcement for increasing the structural strength of the box.

Flap members formed upon each of the two side members define a top which is closable so as to contain the produce within the container.

The bottom member, two side members, and flap members are preferably integrally formed so as to simplify the fabrication process for the container. Thus, the bottom member, two side members, and flap members may be die cut or otherwise formed from a single sheet of corrugated cardboard and then folded to the configuration of the container. The solid fiberboard reinforcing end members preferably have a thickness of at least 0.10, preferably approximately 0.18, so as to result in a box having structural strength sufficient to support at least two thousand pounds of weight stacked thereupon. Thus, sufficient structural strength is provided so as to withstand the weight of a plurality of similar filled containers stacked thereabove, as well as the forces encountered in handling and shipping thereof.

At least one slot, preferably two, are formed upon each of the end members and two corresponding tabs are formed upon each flap member such that the tabs are engageable to the slot so as to close the container. The slots into which the tabs of the flap members are inserted to close the box are preferably formed within the stacking alignment tabs.

Two scores are preferably formed in each corrugated cardboard flap member so as to allow bending of portions of each flap member in order to facilitate engagement of the tabs with the slots. The scores are preferably formed so as to form generally triangular bend portions. Bending of the bend portions allowing the tabs to be inserted into the slots.

Scores formed in the solid fiberboard end members facilitate bending of portions thereof to facilitate attachment of the end members to the side members, preferably via gluing. The bent portions of the end members overlap portions of the side members to facilitate attachment of the end members to the side members. Those skilled in the art will recognize various other means of attachment are likewise suitable. For example, the end members may be stapled, taped, or otherwise attached to the side members of the container.

Alignment tabs formed upon the end members are likewise constructed of solid fiberboard and thus likewise resist degradation caused by moisture and/or handling. They therefore continue to function to maintain alignment of a stack of such containers even if wetted.

Thus, these as well as other advantageous of the present invention will be more apparent from the following description and drawings. It is understood that changes in the specific structure shown and described may be made within the scope of the claims without departing from the spirit of the invention.

DETAILED DESCRIPTION OF THE PREFERRED EMBODIMENT

Figure 1:
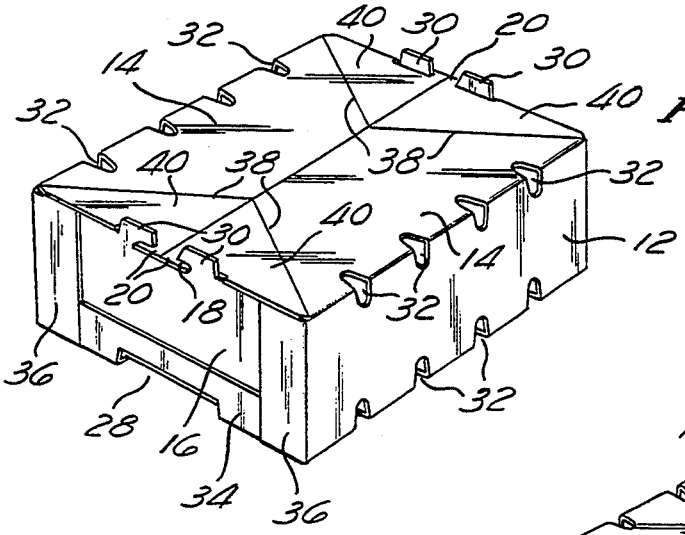
FIG. 1 is a perspective view of the fruit and produce container of the present invention showing the container in a closed configuration.

The detailed description set forth below in connection with the appended drawings is intended as a description of the presently preferred embodiment of the invention, and is not intended to represent the only form in which the present invention may be constructed or utilized. The description sets forth the functions and sequential steps for constructing and operating the invention in connection with the illustrated embodiment. It is to be understood, however, that the same or equivalent functions and sequences may be accomplished by different embodiments that are also intended to be encompassed within the spirit and scope of the invention.

The fruit and produce carton of the present invention is illustrated in FIGS. 1–9 which depict a presently preferred embodiment of the invention. Referring now to FIGS. 1–9, the present invention is comprised of a generally rectangular bottom member 10; two generally rectangular side members 12 formed to said bottom member; two generally rectangular flap members 14, one flap 14 being formed to each of said side members 14 so as to define a top; and two generally rectangular end members 16 attached to said bottom member 10 and said side members 12.

The two end members 16 are preferably adhesively bonded to the bottom member 10 and the side members 12. However, those skilled in the art will recognize that various other methods of attachment, i.e., stapling, etc., are likewise suitable.

Two slots 18 are formed within each end member 16 and two tabs 20 are formed upon each flap 14 such that the tabs 20 are engageable to the slots 18 so as to close the container. Alternatively, a single slot 18 formed in each end member 16 receives both tabs 20 at either end of the top so as to close the box.

The bottom member 10, two side members 12, and two flap members 14, are preferably integrally formed of corrugated cardboard and the end members 16 are formed of solid fiberboard so as to define reinforcement for increasing the structural strength of the container.

The end members 16 preferably have a thickness of at least 0.10 inch, preferably approximately 0.18 inch. In the preferred embodiment, the fruit and produce container measures approximately 17 inches long, 13.75 inches wide, and 5.75 inches high.

The solid fiberboard end men%hers 16 of the fruit and produce container have bends 22 formed thereon such that they overlap and lie in laminar juxtaposition to portions of the side members 12 to which they are attached, preferably via adhesive bonding. Scores 24 formed in the end members 16 facilitate bending of the end members 16 so as to form the bend 22. End member cut-outs 26 formed along the lower edge of the end member 16 form a portion of cut-outs 28 formed adjacent the end members 16 and bottom member 10 of each box. Stacking alignment tabs 30 are formed along the upper edge of each end member 16 so as to be inserted into the cut-outs 26 of those fruit and produce cartons stacked thereabove.

Two stacking alignment tabs 30 are preferably formed having slots 18 formed between themselves and the remainder of the end member 16 upon which they are formed such that the slots 18 open toward one another. Alternatively, a single stacking alignment tab having a single slot 18 formed therein, the slot having no open end, may be formed. Those skilled in the art will recognize that various other configurations of tabs and slots are likewise suitable.

In the preferred embodiment of the present invention, ventilation openings 32 are formed adjacent the side members 12 and the flap members 14 as well as adjacent the side members 12 and the bottom member 10. These ventilation openings 32 facilitate circulation of inert gases, pesticides, fungicides, etc. into the interior of the fruit and produce carton such that the contents thereof are thoroughly exposed thereto. The circulation of such gasses and/or chemical agents about the contents of fruit and produce containers is commonly practices so as to mitigate infestation of insects, fungus and/or any other undesirable organisms.

The intersections of the side members 12 with the flap members 14 as well as the intersections of the side members 12 with the bottom member 10 may optionally be beveled so as to further facilitate the circulation of such gasses and/or agents between adjacent stacked cartons. Such bevels (not shown) define conduits where four such stacked adjacent cartons abut.

The bottom member 10 comprises upwardly extending bends 34 disposed in laminar juxtaposition to the outer surface of each end member 16, which are preferably adhesively bonded thereto.

In a similar fashion bends 36 are formed in side members 12 and likewise are disposed in laminar juxtaposition to the end members 16 and are preferably adhesively bonded thereto.

Figure 7:
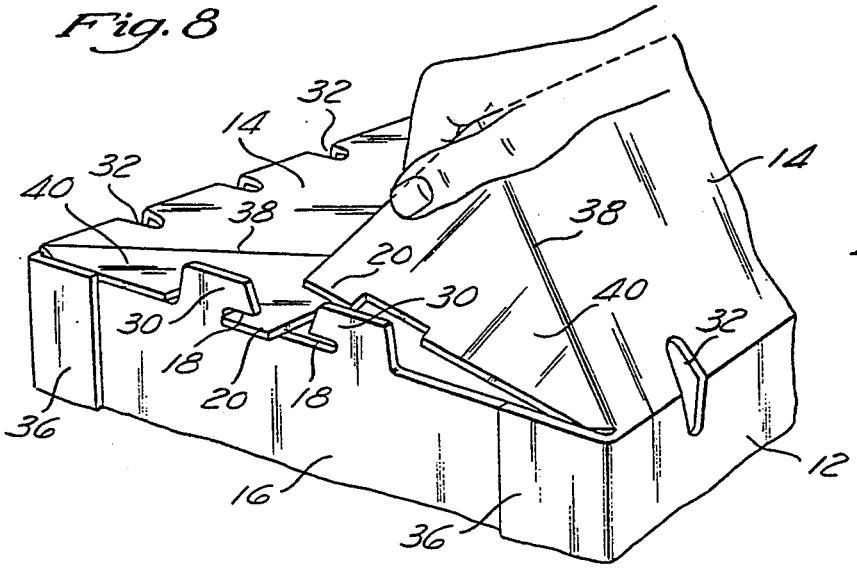
FIG. 7 is a fragmentary perspective view illustrating engagement of a tab formed upon a flap with a slot formed within an end member to close the carton.

Score lines 38 are preferably formed upon each flap member 14 so as to define bendable portion 40 of each flap member 14. The bendable portions 40 of each flap 14 facilitate insertion of the tabs 20 of the flap 14 into the slots 18 of the end member 16, as illustrated in FIG. 7.

Use of the solid fiberboard end member 16, defining reinforcement of the fruit and produce container, increases the structural strength of the fruit and produce container such that it will support stacked loads in excess of two thousand pounds. Through empirical testing it has been found that stacked loads of approximately six thousand pounds may be supported by the present invention.

Both the corrugated cardboard and solid fiberboard portions of the fruit and produce container of the present invention may be formed via dye cutting of sheet stock materials. Those skilled in the art will recognize that various other methods of forming the corrugated cardboard and solid fiberboard portions of the present invention are likewise suitable.

The overlapping portions of the fruit and produce container of the present invention are preferably attached to one another via adhesive bonding. Those skilled in the art will recognize that various other means, i.e., stapling, etc. are likewise suitable.

Although corrugated cardboard and solid fiberboard are referred to throughout this specification, those skilled in the art will recognize that various other materials are likewise suitable and are therefore equivalent thereto.

Having thus described the structure of the fruit and produce carton of the present invention, it may be beneficial to describe the use thereof. Fruit, produce or other perishable food products are placed in the interior of the container and the tabs 20 of the flaps 14 are inserted into the slots 18 of the end members 16 to close the container as shown in FIG. 7.

Figure 2:
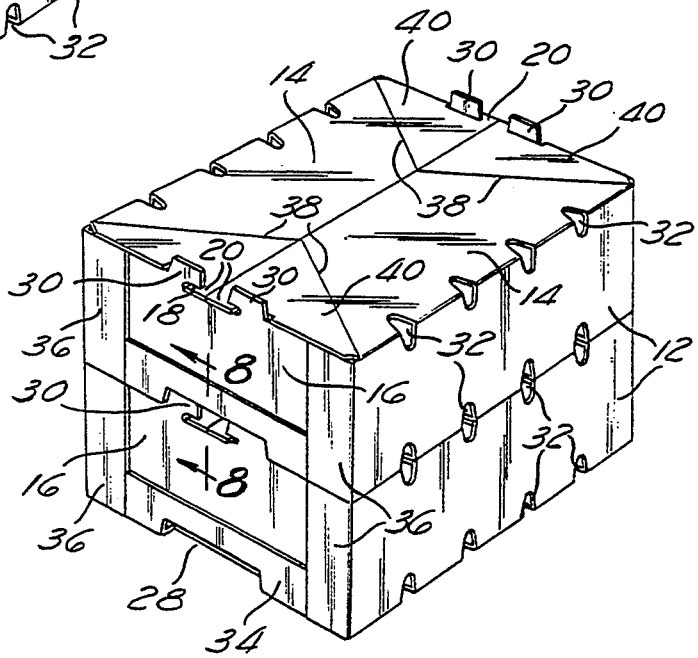
FIG. 2 is a perspective view of two stacked fruit and produce containers of the present invention.
Figure 3:
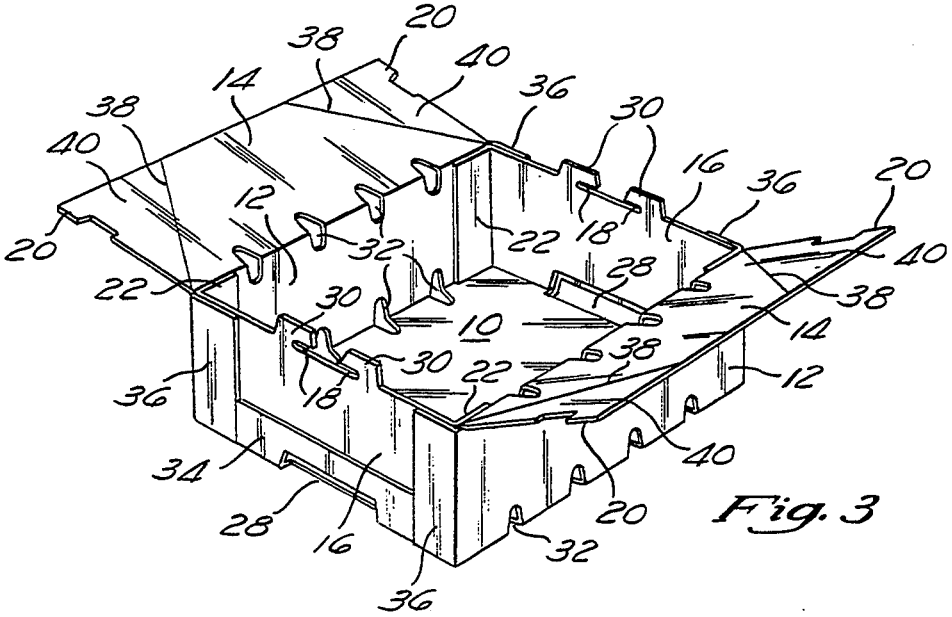
FIG. 3 is a perspective view of the fruit and produce container of the present invention showing the container in an open configuration.
Figure 4:
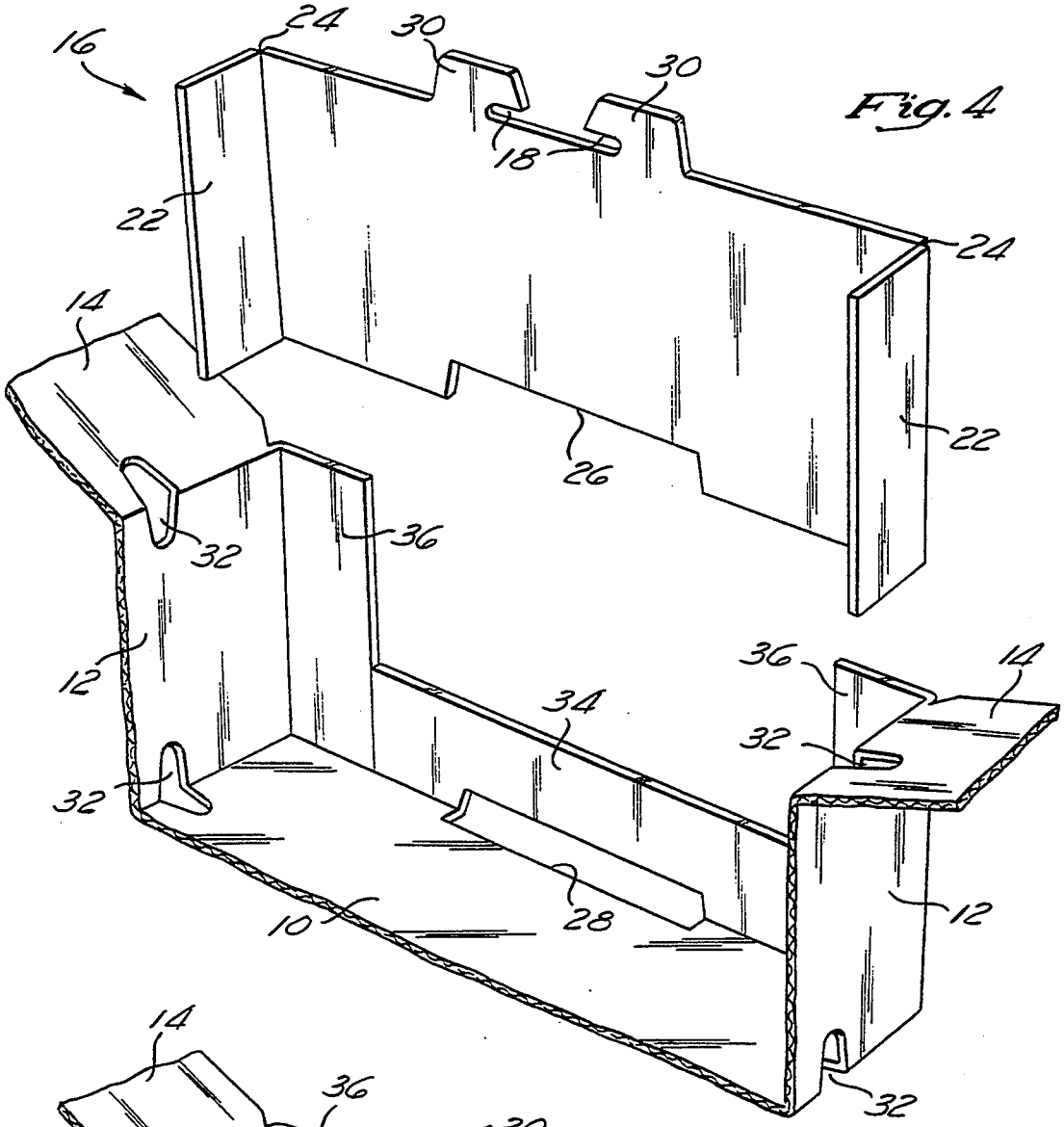
FIG. 4 is an enlarged exploded perspective view of one end of the fruit and produce container of the present invention.
Figure 5:
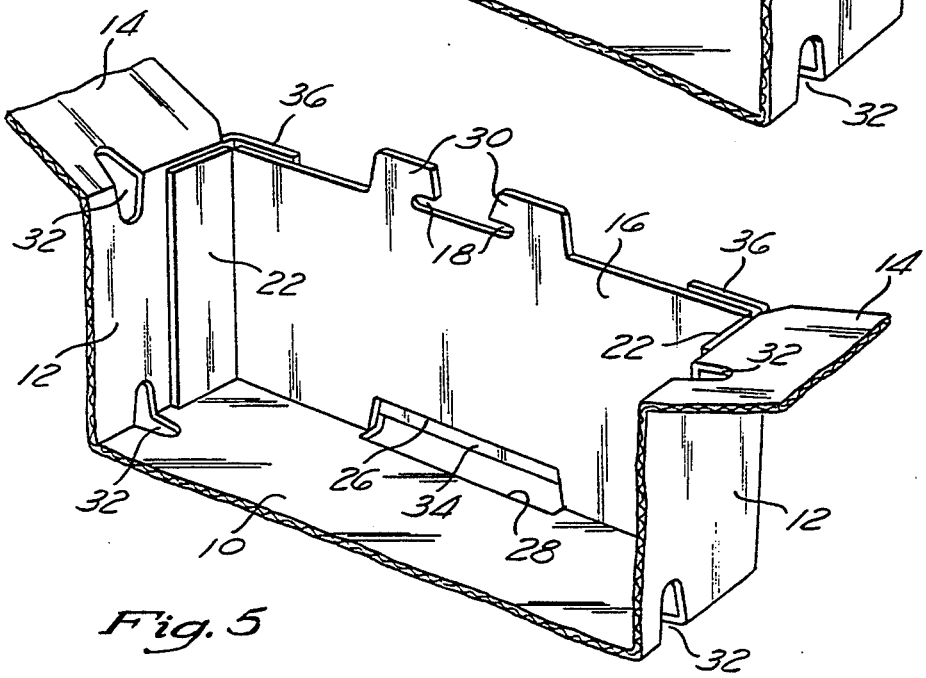
FIG. 5 is an enlarged perspective view of the end of the fruit and produce container of FIG. 4 showing the end member inserted therein.
Figure 6:
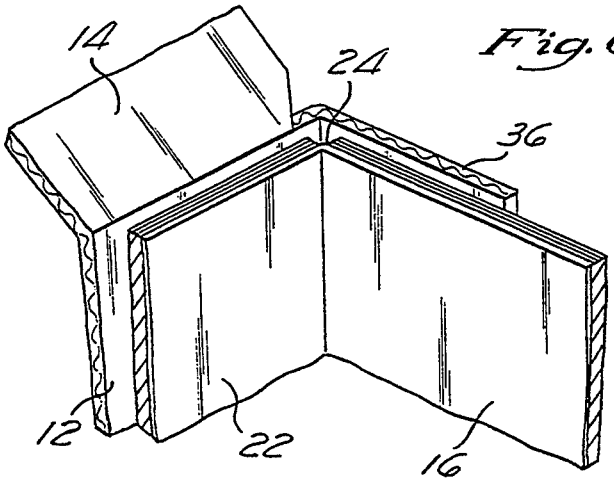
FIG. 6 is an enlarged perspective view of an upper corner of the fruit and produce carton showing the bend formed in the end member along the score line thereof.
Figure 9:
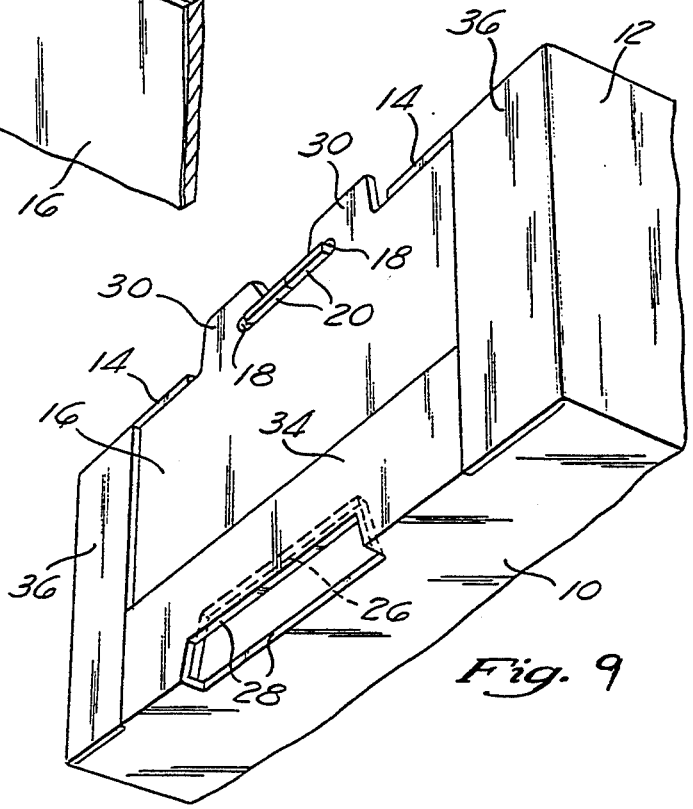
FIG. 9 is a perspective view of an end of the fruit and produce container of the present invention showing a cut-out formed in the bottom and end thereof.
Figure 8:
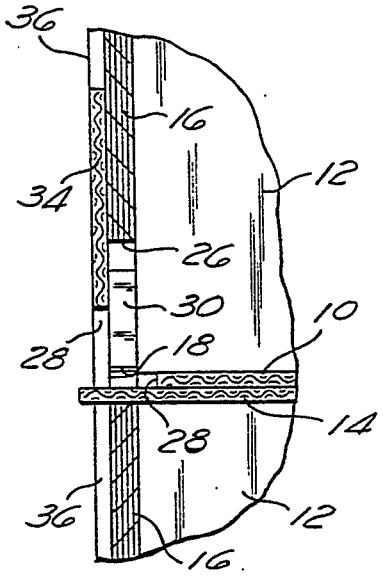
FIG. 8 is a sectional view taken along lines 8 of FIG. 2.

A plurality of fruit and produce containers of the present invention containing such fruit, produce or other perishable food products are stacked as illustrated in FIG. 2. The stacking alignment tabs 30 of each lower stacked container are received by the cut-outs 28 of each higher stacked container to facilitate alignment of the stack and to prevent toppling thereof during transportation and handling.

The fruit and produce container of the present invention may be transported and/or stored, particularly in cold storage, for extended periods of time. Such extended usage is possible since the solid fiberboard end members 16 are not particularly susceptible to degradation caused by the absorption of moisture. Thus. The length of time for which fruit and/or produce may be stored within the containers is not limited by degradation of the containers in which they are stored due to moisture absorption. Rather, the length of time during which fruit and/or produce may be stored within the containers of the present invention is limited by degradation of the contents of the container.

Fruit and produce containers of the present invention may easily be recycled without the need for any disassembly thereof. Thus, the entire fruit and produce container of the present invention may be recycled into a wide variety of paper products thus, mitigating environmental concerns over the use thereof.

It is understood that the exemplary fruit and produce container described herein and shown in the drawings represents only the presently preferred embodiment of the invention. Indeed, various modifications and additions may be made to such embodiment without departing from the scope of the invention. For example, the configuration of the bottom member 10, side members 12, flap members 14, and/or end members 16 need not be generally rectangular as described and illustrated, but rather those skilled in the art will recognize that various other configurations, i.e., triangular, octagonal, circular, etc. are likewise suitable. Also, a wide variety of configurations of stacking alignment means, i.e., stacking alignment tabs 30 and cut-outs 28, are contemplated. Thus, these and other modifications and additions may be obvious to those skilled in the art and may be implemented to adapt the present invention for use in a variety of different applications.

What is claimed is:

1. A container comprising:

a) a bottom member;

b) a plurality of upwardly extending planar first members formed to said bottom member and defining walls of said container, said first members comprising corrugated cardboard;

c) at least one upwardly extending second member formed to said bottom member and defining reinforcement for increasing the structural strength of the container, said second member(s) comprising solid fiberboard; and d) wherein said second member(s) define walls of said container.

2. The container as recited in claim 1 wherein:

a) said bottom member is generally rectangular in shape.

b) said plurality of upwardly extending planar first members comprises two upwardly extending planar first members defining side walls, both of said side walls being generally rectangular in shape; and c) said at least one upwardly extending second member comprises two upwardly extending planar second members defining end walls, both of said end walls being generally rectangular in shape.

3. The container as recited in claim 2 further comprising a top formed to at least one of the said side member walls and comprised of corrugated cardboard.

4. A reinforced box comprising:

a) a bottom member;

b) two side members formed to said bottom member;

c) two end members formed to said bottom member;

d) wherein said bottom member and said two side members are formed of corrugated cardboard and said two end members are formed of slid fiberboard, said solid fiberboard end members defining reinforcement for increasing the structural strength of the box.

5. The reinforced box as recited in claim 4 wherein said bottom member and said two side members are integrally formed.

6. The reinforced box as recited in claim 4 wherein said end members have a thickness of approximately 0.18 inch.

7. The reinforced box as recited in claim 4 wherein said end members are configured to increase the structural strength of the box such that the box will support 2,000 pounds of weight stacked thereupon.

8. The reinforced box as recited in claim 4, wherein said bottom member, said side members, and said end members are generally rectangular in configuration.

9. The reinforced box as recited in claim 4 further comprising one flap member formed to each of said side members so as to define a top.

10. The reinforced box as recited in claim 9 further comprising at least one slot formed upon each of said end members and two tabs formed upon each of said flap members such that said tabs are engageable to said slots so as to close said container.

11. The reinforced box as recite din claim 9 further comprising two scores formed in each of said flap members to allow bending of each of said flap members so as to facilitate engagement of said tabs with said slots.

12. The reinforced box as recited in claim 4 further comprising scores formed in said end members such that portions thereof are bent to overlap and attach to said side members.

13. The reinforced box as recited in claim 4 wherein said end members are adhesively bonded to said side members and said bottom member.

14. The reinforced box as recited in claim 9 further comprising:

a) alignment tabs formed upon said end members;

b) complimentary cut-outs formed adjacent said bottom member and said end members; and c) wherein insertion of alignment tabs of an inferiorly stacked box into cut-outs of a superiorly stacked box facilitates stacking thereof.

15. The reinforced box as recited in claim 14, wherein slots are formed in said alignment tabs.

16. A reinforced box for storing and transporting produce, said box comprising:

a) a generally rectangular bottom member;
b) two generally rectangular side members formed to said bottom member;
c) one flap member formed to each of said side members so as to define a top;
d) two generally rectangular end members formed to said bottom member and said side members;
e) at least one slot formed upon each of said end members and two tabs formed upon each of said flap members such that said tabs are engageable to said slots so as to close said container; and
f) wherein said bottom member, said two side members, and said two flap members are integrally formed of corrugated cardboard and said end members are formed of solid fiberboard so as to define reinforcement for increasing the structural strength of the container.

* * * * *